US006358083B1

(12) United States Patent
Kraft

(10) Patent No.: US 6,358,083 B1
(45) Date of Patent: Mar. 19, 2002

(54) COMMUNICATIONS CABLING SYSTEM WITH SERIALLY CONNECTABLE UNIQUE CABLE ASSEMBLIES

(75) Inventor: James L. Kraft, York, PA (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 09/695,653

(22) Filed: Oct. 24, 2000

Related U.S. Application Data

(62) Division of application No. 09/163,886, filed on Sep. 30, 1998, now Pat. No. 6,168,458.

(51) Int. Cl.[7] ..... H01R 3/00
(52) U.S. Cl. ..... 439/488; 439/502
(58) Field of Search ..... 439/488, 502, 439/623; 174/71 R, 72 A, 72 R

(56) References Cited

U.S. PATENT DOCUMENTS 3,605,068 A * 9/1971 Rayburn ..... 439/488
3,667,101 A * 6/1972 Kloth ..... 439/623
4,643,509 A * 2/1987 Hollyday et al. ..... 439/607
4,911,652 A * 3/1990 Savoca et al. ..... 439/282
5,168,124 A * 12/1992 Takase et al. ..... 174/72 A
5,399,106 A * 3/1995 Ferry ..... 439/620
5,888,100 A * 3/1999 Bofill et al. ..... 439/676
5,917,151 A * 6/1999 O'Brien et al. ..... 174/72 A
5,954,538 A * 9/1999 Huang ..... 439/502
5,961,354 A * 10/1999 Hashim ..... 439/676
5,971,799 A * 10/1999 Swade ..... 439/502
6,102,745 A * 8/2000 Schultz et al. ..... 439/638

* cited by examiner

*Primary Examiner*—Brian Sircus
*Assistant Examiner*—Hae Moon Hyeon
(74) *Attorney, Agent, or Firm*—Foley & Lardner

(57) ABSTRACT

A communications cabling system adapted for being installed adjacent a first side of a structure having a port communicating with a second side of the structure includes a plurality of unique cable assemblies. Each cable assembly includes a plurality of wires having first and second ends, a first connector having a first plurality of electrical contacts electrically connected to each of the plurality of wires at the first end, a second connector having a second plurality of electrical contacts electrically connected to a first unique subset of the plurality of wires at the second end and a third connector having a third plurality of electrical contacts electrically connected to a second unique subset of the plurality of wires at the second end. At least one of the first, second and third connectors is configured for being supported proximate the port. At least one of the first, second and third connectors includes a portion accessible from the second side. The portion has a unique indicia corresponding to and associated with each unique cable assembly. As a result, the unique indicia indicates at least one of the first and second unique subsets of wires terminating in the second and third connectors, respectively. Preferably, the unique indicia comprises a unique color indicia. In at least one of the first, second and third connectors, a second plurality of electrical contacts are interleaved amongst the first plurality of electrical contacts electrically connected to the plurality of wires. The second plurality of electrical contacts are electrically interconnected to one another.

23 Claims, 5 Drawing Sheets

COMMUNICATIONS CABLING SYSTEM WITH SERIALLY CONNECTABLE UNIQUE CABLE ASSEMBLIES

CROSS-REFERENCES TO RELATED APPLICATIONS

This application is a divisional of U.S. Ser. No. 09/163,886, filed Sep. 30, 1998, mow U.S. Pat. No. 6,168,458.

FIELD OF THE INVENTION

The present invention relates to telecommunications and devices for transmitting analog and digital electrical signals. In particular, the present invention relates to a modular cable system for providing communications to a plurality of workstations, which is easy to install and which reliably transmits data at a high rate.

BACKGROUND OF THE INVENTION

Communications cabling systems transmit information or data in the form of analog or digital electrical signals to and from various offices or workstations. Such cabling systems communicate between a distribution block or a patch panel located in a computer room or closet and telecommunication devices located at the workstations, including telephones, facsimile machines and computers. These cabling systems typically comprise either a single set of continuous wires or, more recently, a series of modular cable assemblies. The use of modular cable assemblies has become increasingly popular because modular cable assemblies permit moves, adds and changes to the cabling system without requiring that the entire system be rewired. Despite the increasing popularity of modular cable systems, such modular cabling systems have several drawbacks.

One drawback with modular cabling systems is that they can be relatively difficult or confusing for relatively unskilled or inexperienced workers to install properly. This problem can be further exacerbated where the modular cable systems includes what will herein be referred to as Y-cable assemblies, which are a relatively recent development. Each Y-cable assembly includes wiring for multiple offices or workstations and includes three connectors. The Y-cable assemblies are interconnected to one another in series to provide the necessary wiring for the individual offices or workstations. Each Y-cable assembly extracts a unique subset of the wires for use by one particular office or workstation. Because each cable assembly extracts a unique subset of wires for use by a particular office or workstation, it is necessary that the different Y-cable assemblies be distinguished from one another to ensure that (1) the proper subset of wires is extracted for use by each particular office or workstation and that (2) two or more identical cable assemblies are not interconnected along the same series of Y-cable assemblies. Because existing Y-cable assemblies are typically distinguished only by a particular part number stamped on one of the connectors, ensuring that the correct Y-cable assemblies are used is difficult since the randomly assigned part numbers must be memorized or written down. Moreover, performing moves, adds or changes on an existing system is further complicated in that such part numbers are typically stamped on portions of the connectors which are not visible once the cable assemblies are installed. As a result, the installer must either remove each of the Y-cable assemblies from the wall or other structure to identify each Y-cable assembly and its unique set of extracted wires or must locate and read any existing written records of the wiring scheme.

Second, existing modular cable systems often use cables which are capable of communicating at Category 5 or higher performance levels, but the connectors can be a weak point which may limit the overall capabilities of the system. NEXT, or near end cross-talk, is a measure of the amount of signal coupling (or cross-talk) which occurs between different pairs of wires in the cables and the connectors, particularly between each transmit pair and its associated receive pair. Such cross-talk is a source of interference that degrades the ability of the system to transmit or receive signals. As transmission rates increase, near end cross-talk also increases. It has been discovered that terminating the wire pairs at pin positions so as to leave empty (or unused) pins between the wire pairs reduces such cross-talk in the connectors and thus enables higher data transmission speeds. Nevertheless, with the continuing demand for faster and faster data transmission rates, there remains a need for cable assemblies that further reduce cross-talk at higher transmission rates.

SUMMARY OF THE INVENTION

The present invention provides a communications cabling system having a plurality of unique cable assemblies configured to be serially connected to one another. Each cable assembly includes a plurality of wires having first and second ends, a first connector having a first plurality of electrical contacts electrically connected to each of the plurality of wires at the first end, a second connector having a second plurality of electrical contacts electrically connected to a first unique subset of the plurality of wires at the second end, a third connector having a third plurality of electrical contacts electrically coupled to a second unique subset of the plurality of wires at the second end, and a unique color indicia corresponding to and associated with each unique cable assembly. The color indicia visually indicates at least one of the first and second unique subsets of wires terminating in the second and third connectors, respectively.

The present invention also provides a communications cabling system adapted for being installed adjacent a first side of a structure having a port communicating with a second side of the structure. The cabling system includes a plurality of unique cable assemblies configured to be serially connected together. Each cable assembly includes a plurality of wires having first and second ends, a first connector having a first plurality of electrical contacts electrically connected to each of the plurality of wires at the first end, a second connector having a second plurality of electrical contacts electrically connected to a first unique subset of the plurality of wires at the second end, and a third connector having a third plurality of electrical contacts electrically connected to a second unique subset of the plurality of wires at the second end. At least one of the first, second and third connectors is configured for being supported proximate the port. The at least one of the first, second and third connectors includes a portion accessible from the second side. The portion has a unique indicia corresponding to and associated with each unique cable assembly. The unique indicia indicates at least one of the first and second unique subsets of wires terminating in the second and third connectors, respectively.

The present invention also provides a modular communications electrical connector including a plurality of electrical contacts. At least two of the plurality of electrical contacts are electrically interconnected and are separated by at least one non-interconnected electrical contact.

The present invention also provides a cross talk reduction device for use with a modular communications electrical connector having a plurality of electrical contacts. The cross talk reduction device includes a body configured for being attached to the connector and an electrically conductive material supported by the body and configured to extend from a first contact to a second non-adjacent contact of the plurality of electrical contacts.

The present invention also provides a method for improving performance in a modular communications electrical cable assembly having a connector with a first plurality of electrical contacts electrically connected to a plurality of wires and a second plurality of electrical contacts interleaved between the first plurality of electrical contacts. The method comprises electrically interconnecting together the second plurality of electrical contacts.

The present invention also provides a method for installing a communications cabling system using a plurality of cable assemblies, wherein each cable assembly includes a first connector, a second connector, a third connector, a first unique set of electrical wires connecting the first connector to the second connector, a second unique set of electrical wires connecting the first connector to the third connector, and a unique color indicia associated with each cable assembly based upon the second unique set of electrical wires connecting the first connector and the third connector. The method includes the steps of selecting at least two cable assemblies to form a set in which no two cable assemblies of the set share the same color, and serially connecting the at least two cable assemblies together in any order.

DETAILED DESCRIPTION OF THE PREFERRED EMBODIMENTS

Figure 1:
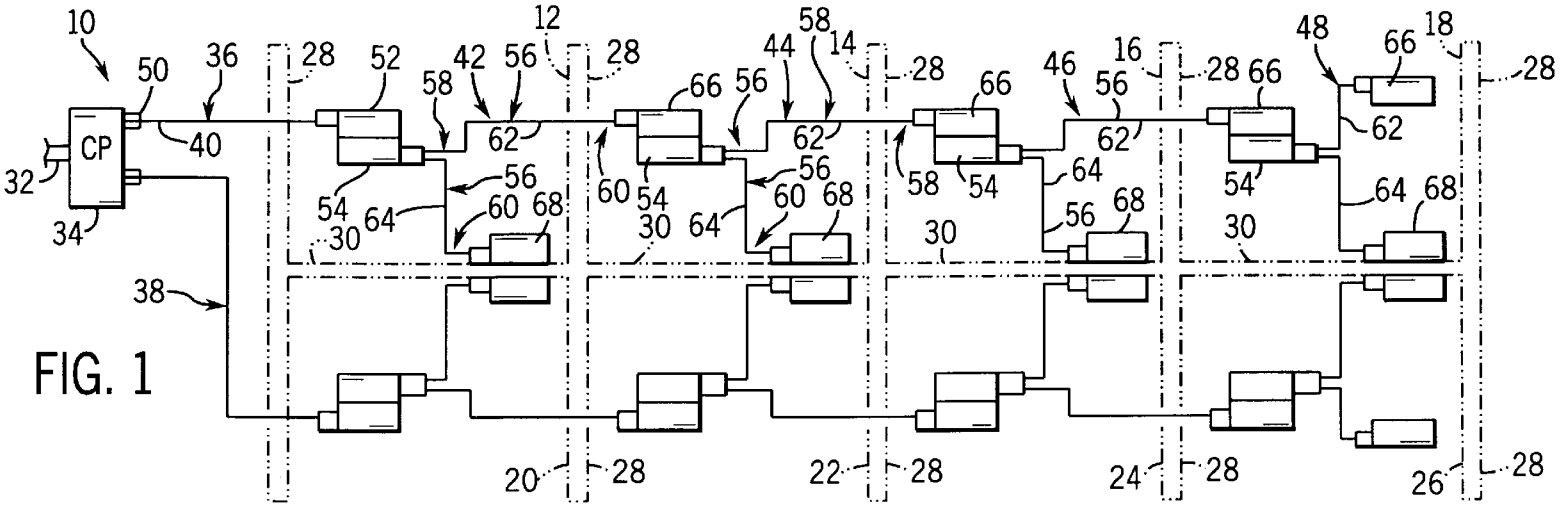
FIG. 1 is a schematic illustration depicting an exemplary cable system of the present invention including two cable subsystems installed to provide communications to workstations.

FIG. 1 is a schematic view of a cabling system 10 installed to provide communications to eight office units or workstations 12, 14, 16, 18, 20, 22, 24 and 26 divided by partitions 28 and 30. Cabling system 10 includes a horizontal distribution cable (HDC) 32, a consolidation point 34, and cable subsystems 36 and 38. Distribution cable 32 is a conventionally known cable segment having multiple electrical leads or wires. Cable 32 communicates between a distribution block, patch panel, TELCO distribution interface (not shown) or other modular closet interface device located in the computer room or closet (not shown) and consolidation point 34. As conventionally known, the distribution block represents the demarcation point between the local telephone company or wide area network and the owner of the office distribution network. Cable 32 may extend through the floor, ceiling, furniture panel or column of the building as is known in the art and depending upon the location of consolidation point 34. Although cable 32 and the wiring at consolidation point 34 are preferably modular, permanent or fixed schemes are also contemplated.

Consolidation point 34, also known as a distribution point, comprises a location where a first set of wires joins with a second set of wires. Consolidation point 34 comprises an organizer bracket located between cable 32 and cable subsystems 36 and 38. Consolidation point 34 provides a single location at which cable subsystems 36 and 38 are electrically connected to cable 32. Consolidation point 34 is preferably permanently situated at a location such as a ceiling, floor, furniture panel or building support. Consolidation point 34 eliminates the requirement of individual cable lengths extending from the distribution block or patch panel to each individual office unit or workstation. As will be appreciated, cabling system 10 may include additional consolidation points as necessary.

Cable systems 36 and 38 are modular in nature and provide telecommunications from consolidation point 34 to each of the workstations 12–26. Cable system 36 and 38 are substantially identical to one another. Thus, for purposes of brevity, only cable system 36 is discussed hereafter. Cable system 36 generally includes feeder cable 40 and break-out or diversion cable assemblies 42, 44, 46 and 48. Feeder cable 40, also known as an X-type cable, comprises a conventionally known cable carrying a plurality of wires from consolidation point 34 to diversion cable assembly 42. Although not shown, additional feeder cables 40 could of course be located further downstream such as between diversion cable assemblies 44 and 46. Feeder cable 40 is preferably modular and includes a first connector 50 removably connected to consolidation point 34 and a second connector 52 removably connected to diversion cable assembly 42. Connectors 50 and 52 provide a plurality of electrical contacts, preferably pins, which are electrically connected to a corresponding plurality of electrical wires extending between connectors 50 and 52. Feeder cable 40 carries a plurality of electrical circuits, grouped into distinct subsets of wires, to diversion cable assemblies 42, 44, 46 and 48.

Still referring to FIG. 1, diversion cable assemblies 42, 44, 46 and 48 each generally include a first connector 54, a plurality of wires 56, a second connector 66, and a third connector 68. The plurality of wires 56 are selectively grouped to form a main lead 62 and an extraction lead 64, each of which has a first end 58 and a second end 60. First connector 54 includes a plurality of electrical contacts electrically connected to each of the plurality of wires 56 of both main lead 62 and extraction lead 64 at first end 58. Wires 56 of leads 62 and 64 preferably comprise well known insulated telecommunication wires or "Inside Wires" which are arranged in twisted pairs to reduce cross-talk in a conventionally known manner. Wires 56 provide telecommunication pathways from connector 54 to connectors 66 and 68. Wires 56 of main lead 62 extend from first connector 54 to second connector 66. Wires 56 of extraction lead 64 extend from first connector 54 to third connector 68. Second connector 66 includes a second plurality of electrical contacts electrically connected to each of the wires 56 of main lead 62 at second end 60. Third connector 68 has a third plurality of electrical contacts electrically coupled to each of the plurality of wires 56 of extraction lead 64 at second end 60. Connectors 52, 54, 66 and 68 preferably comprise conventionally-known AMP 50 pin (25 pair) connectors which have been modified according to the present invention to reduce cross-talk as described in greater detail hereafter. As will be appreciated, however, connectors 52, 54, 66 and 68 may comprise other well-known connector arrangements. For example, connector 68 may alternatively comprise conventionally-known RJ45, RJ12 or RJ11-type connectors or interfaces. The only requirement is that connector 54 must be able to mate with connector 66.

In short, each diversion cable assembly 42, 44, 46 and 48 diverts a unique subset of wires 56 from first connector 54 through extraction lead 64 to third connector 68. The remainder of wires 56 continue to pass on from first connector 54 through main lead 62 to second connector 66 and thereby to the next interconnected cable assembly. The extraction lead 64 of each cable assembly 42, 44, 46 and 48 includes a unique subset of wires 56. Likewise, each main lead 62 of cable assemblies 42, 44, 46 and 48 includes a unique set of wires 56. Thus, cable assemblies 42, 44, 46 and 48, when interconnected in series, provide wiring for multiple offices or workstations while enabling particular unique sets of wires to be diverted or extracted to provide communication for each office or workstation.

Figure 2:
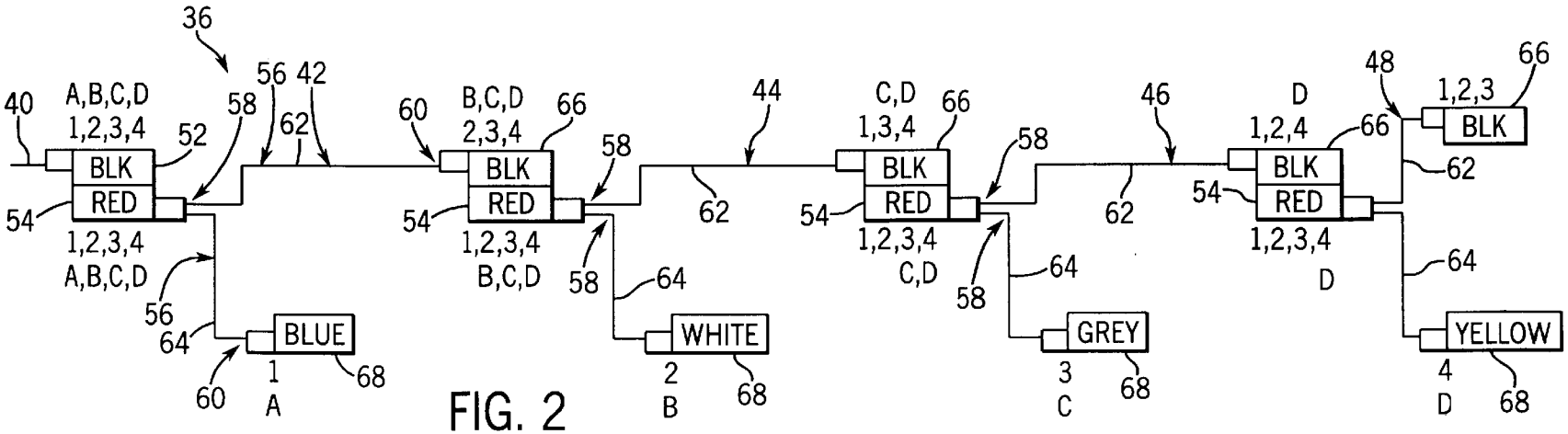
FIG. 2 is a schematic illustration depicting a first one of the cable subsystems of FIG. 1 in greater detail.

FIG. 2 is a schematic illustration depicting cable subsystem 36 in greater detail. As best shown by FIG. 2, cable subsystem 36 utilizes cable assemblies 42, 44, 46 and 48 to distribute a set of wires comprising wire subsets (or circuits) 1, 2, 3 and 4 amongst the offices or workstations 12, 14, 16 and 18, respectively. Each of cable assemblies 42, 44, 46 and 48 is unique in that it diverts a different subset 1, 2, 3, 4 of wires 56 to third connector 68 through the associated extraction leads 64. Each cable assembly 42, 44, 46 and 48 also interconnects first connector 54 and second connector 66 with different subsets 1, 2, 3, 4 of wires 56 through main lead 62. As illustrated, main lead 62 of cable assembly 42 includes wire subsets 2, 3 and 4 while extraction lead 64 includes wire subset 1. Main lead 62 of cable assembly 44 includes wire subsets 1, 3 and 4 while extraction lead 64 includes wire subset 2. Main lead 62 of cable assembly 46 includes wire subsets 1, 2 and 4 while extraction lead 64 includes wire subset 3. Lastly, main lead 62 of cable assembly 48 includes wire subsets 1, 2 and 3 while extraction lead 64 includes wire subset 4. Each subset of wires 1, 2, 3 and 4 is associated with specific electrical contacts at connectors 54, 66 and 68. Thus, for example, wire subset 1 of cable assembly 42 will always be electrically connected in series to wire subset 1 of any of the other cable assembly 44, 46 and 48. Because each cable assembly 42, 44, 46 and 48 includes all four subsets, 1, 2, 3 and 4 of wires 56, cable assemblies 42, 44, 46 and 48 are interchangeable and modular.

As further shown by FIG. 2, feeder cable 40 also includes wire subsets 1, 2, 3 and 4 which carry and provide electrical signals A, B, C and D to wire subsets 1, 2, 3 and 4 of cable assembly 42, respectively. When interconnected as illustrated in FIG. 2, wire subset 1 of cable assembly 42 diverts signal A to connector 68 for use in workstation 12. Wire subsets 2, 3 and 4 continue to transmit signals B, C and D to the next consecutive cable assembly 44. Wire subset 2 of cable assembly 44 diverts signal B to its connector 68 for use in workstation 14. Wire subsets 3 and 4 of cable assembly 44 continue to transmit the remaining signals C and D to the next cable assembly 46. Wire subset 3 of cable assembly 46 diverts signal C to its connector 68 for use in workstation 16 while wire subset 4 of cable assembly 46 continues to transmit signal D to cable assembly 48. Lastly, wire subset 4 of cable assembly 48 diverts signal D to its connector 68 for use in workstation 18.

As further shown by FIG. 2, each unique cable assembly 42, 44, 46 and 48 includes a unique indicia corresponding to and based upon the unique wire subsets 1, 2, 3, 4 included in main lead 62 and extraction lead 64. In the exemplary embodiment, each unique cable assembly 42, 44, 46 and 48 includes a unique color indicia associated with the unique wire subsets 1, 2, 3, 4 in leads 62 and 64 of each cable assembly. In the most preferred embodiment, a unique color indicia is provided on each connector 68 and the outer sheath of the extraction lead 64. In particular, cable assembly 42, in which wire subset 1 is diverted by extraction lead 64, includes a blue connector 68 and a blue extraction lead 64. Connector 68 is preferably molded with a blue-colored material. Alternatively, connector 68 may have a blue-colored coating or paint applied thereto or have a blue-colored member adhered or affixed thereto. Likewise, connectors 68 and leads 64 of cable assemblies 44, 46 and 48 include white, gray and yellow color indicia, respectively, corresponding to the wire subsets 2, 3 and 4 being diverted by extraction leads 64 of cable assemblies 44, 46 and 48, respectively.

As a result, cable subsystem 36 has a unique color assignment that enables an installer to quickly and easily distinguish between each of cable assemblies 42, 44, 46 and 48. In addition to enabling cable assemblies 42, 44, 46 and 48 to be visually distinguished from one another at a glance, the color indicia on cable assemblies 42, 44, 46 and 48 enables even an inexperienced installer to easily and quickly install the system or perform moves, adds and changes, simply by following a few easy to remember rules. Specifically, the color indicia eliminates confusion as to which of the wire subsets 1, 2, 3, 4 are available in the cable subsystem 36 for being diverted to a workstation for providing telecommunications to that workstation. For example, the first connector 54 of one of diversion cable assemblies 42, 44, 46 and 48 may be connected to the second connector 66 of any of the other diversion cable assemblies 42, 44, 46 or 48 so long as the color indicia on connectors 68 are not repeated or duplicated any where along the series of interconnected cable assemblies. By following this simple rule, the installer can easily perform moves, adds and changes in the cable subsystem 36.

To further assist in the installation of cable subsystem 36, both connectors of cable 32 and connectors 52 and 66 of feeder cable 40 and cable assemblies 42, 44, 46 and 48 are each provided with a common color indicia. At the same time, connectors 54 of each cable assembly 42, 44, 46 and 48 are each provided with a second common color indicia different from the first color indicia. Preferably, the first and second color indicia associated with connectors 52, 54 and 66 are different from the unique color indicia associated with connectors 68 of diversion cable assemblies 42, 44, 46 and 48. In the exemplary embodiment illustrated, each of connectors 52 and 66 are provided with a black color while each of connectors 54 are provided with a red color.

The color indicia assigned to connectors 52, 54 and 66 further simplify assembly or modifications of cable subsystem 36. In particular, by following the simple rule that only red and black connectors may be mated to one another, the installer is able to quickly and correctly connect cable assemblies 42, 44, 46 and 48 to one another as well as to feeder cable 40. Because the first and second common color indicia assigned to connectors 52, 54 and 66 are different from the unique color indicia associated with connectors 68, inadvertent connection of connector 68 to connector 54 is avoided. Consequently, this unique color coding scheme makes installation of a relative complex modular cable system or subsystem simple and non-threating. In addition, this color assignment scheme also assists in troubleshooting and maintenance by allowing for faster narrowing down of a problem.

Figure 3:
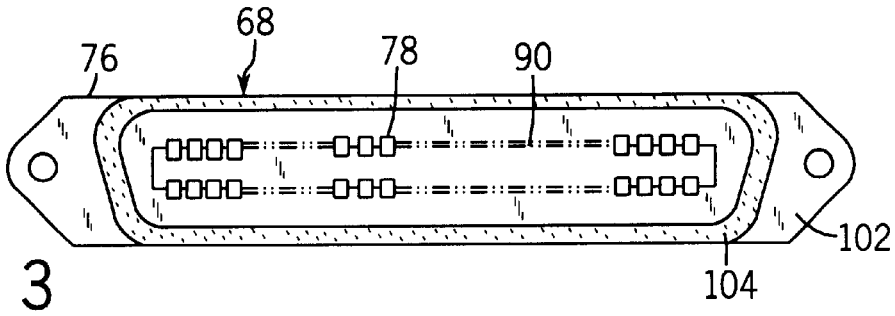
FIG. 3 is a front elevational view of a first end of an exemplary cable assembly for use in the cable subsystem of FIG. 2.
Figure 4:
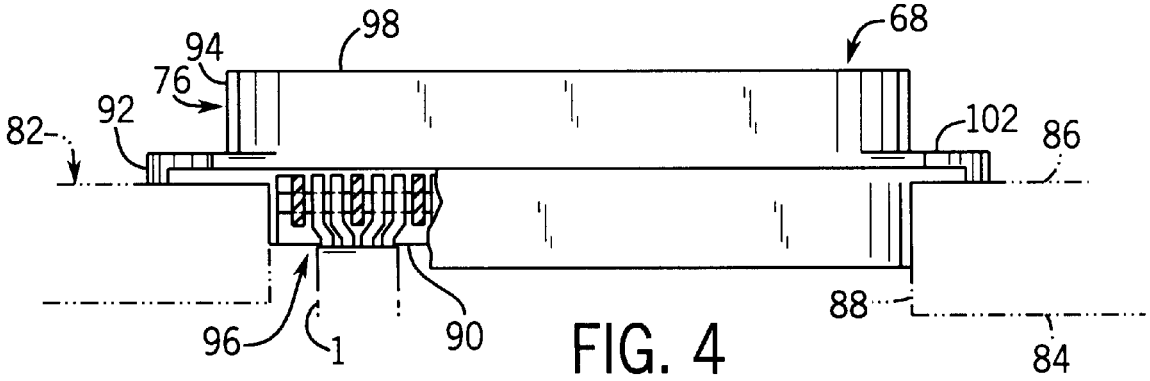
FIG. 4 is a top elevational view of the first end of the cable assembly of FIG. 3 with portions removed for purposes of illustration.

FIGS. 3 and 4 illustrate connector 68 in greater detail. In particular, FIG. 3 is a side elevational view of connector 68 while FIG. 4 is a top elevational view of connector 68 with portions removed for purposes of illustration. As best shown by FIGS. 3 and 4, connector 68 includes a body or casing 76 and electrical contacts 78. As best shown by FIG. 4, connector 68 is adapted for being installed adjacent to structure 82 having a first side 84, a second side 86 and a port 88 communicating through structure 82 from first side 84 to second side 86. Casing 76 is specifically adapted for being positioned proximate port 88 and includes wire attachment portion 90, mounting portion 92 and mating portion 94. Wire attachment portion 90 extends from a first side 96 to a second side 98 of connector 68 and provides a base structure onto which electrical contacts 78 are mounted. Mounting portion 92 projects outward beyond wire connection portion 90 and includes a face 102 extending substantially parallel to second side 86 of structure 82. Mounting portion 92 mounts to structure 82 to support connector 68 adjacent to structure 82. Mating portion 94 extends about electrical contact 78 and provides a first gender type structure configured for mating with a connector or a workstation component having a connector with a second opposite gender structure. In the exemplary embodiment, mounting portion 94 comprises a female gender type member having a face 104 substantially parallel to side 86 of structure 82. As shown by FIG. 4, wire connection portion 90 projects partially through port 88 while mounting portion 92 and mating portion 94 project beyond side 86 of structure 82.

In the exemplary embodiment, face 102 and face 104 are each provided with the unique color indicia assigned to the particular unique cable assembly 42, 44, 46 and 48. Because faces 102 and 104 are each visually accessible to side 86 of structure 82, the installer may quickly and easily identify which subset 1, 2, 3, or 4 of wire 56 is being extracted or diverted by the particular connector 68 for use in the workstation. Because faces 102 and 104 lie on the outside of side 86 of structure 82, the unique color indicia thereon is easily identified and visually accessible without having to remove or in any way disturb connector 68 from port 88. The identification of the unique color indicia associated with surfaces 102 and 104 is further enhanced because surfaces 102 and 104 extend substantially parallel to surface 86 and thus provide a larger visible side 86 area when viewed from the front, as is typical. As a result, in addition to enabling the installer to quickly and easily distinguish between cable assemblies 42, 44, 46 and 48 during the assembly of cable subsystem 36, cable subsystem 36 also enables the installer to quickly and easily identify the particular cable assemblies 42, 44, 46 and 48 already installed adjacent to structure 82. Consequently, the installer can easily determine which cable assemblies 42, 44, 46 or 48 have already been interconnected and installed as part of cable subsystem 36, simply by viewing portions of connector 68 that are accessible on second side 86 of structure 82. Thus, the installer can quickly identify which, if any, additional cable assemblies 42, 44, 46 or 48 may be added and interconnected to the cable system.

Although each cable assembly 42, 44, 46 and 48 is illustrated with a unique color indicia specifically associated with the associated connector 68, the color indicia for each cable assembly may alternatively be associated with the outer casing or sheath encircling wire 56, particularly extractor leads 64. Although the color indicia is preferably associated with portions of connector 68 which are visually accessible on second side 86 of structure 82, e.g., visible from the outside of a modular wall panel, the color indicia may be associated with other portions of connector 68.

In addition or alternatively to having unique color indicia visually accessible when installed, connector 68 may further include a unique surface texture indicia on face 104 corresponding to and associated with the unique wire subset 1, 2, 3 or 4 being diverted by extraction lead 64 of the particular cable assembly 42, 44, 46 or 48. Such unique surface texture enables the installer to quickly and easily identify the particular cable assembly and its associated unique subset 1, 2, 3, or 4 of wires 56 being diverted by extraction lead 64 by simply touching or feeling face 104. This feature is extremely advantageous where surface 102 and 104 would be difficult to see due to poor lighting, due to visual impairments of the installer, or due to furniture or other obstructions which block the installer's view of surfaces 102 and 104 on side 86 of structure 82.

As will further be appreciated, the exact configuration of connector 68 will vary depending upon configuration of structure 82, the size and shape of port 88 as well as the size and configuration of the opposing mating connector for mating with connector 68. For example, the mounting portion 92 may alternatively be configured for mounting to side 84 of structure 82 wherein connector 68 projects completely through port 88 beyond side 86 or wherein connector 68 is recessed within port 88 or behind side 84 of structure 82. The only requirement is that at least a portion of connector 68 including the unique identifying indicia, such as color or texture, is accessible (either visually or tactilely) after installation of connector 68 to structure 82 without need to disturb connector 68. Although connector 68 is illustrated as being mounted to structure 82 comprising a generally planar panel or wall, connector 68 may alternatively be configured for mounting to a structure such as a floor, ceiling, piece of furniture or other article having a wall and a port communicating from a first side to a second side of the wall.

Figure 5:
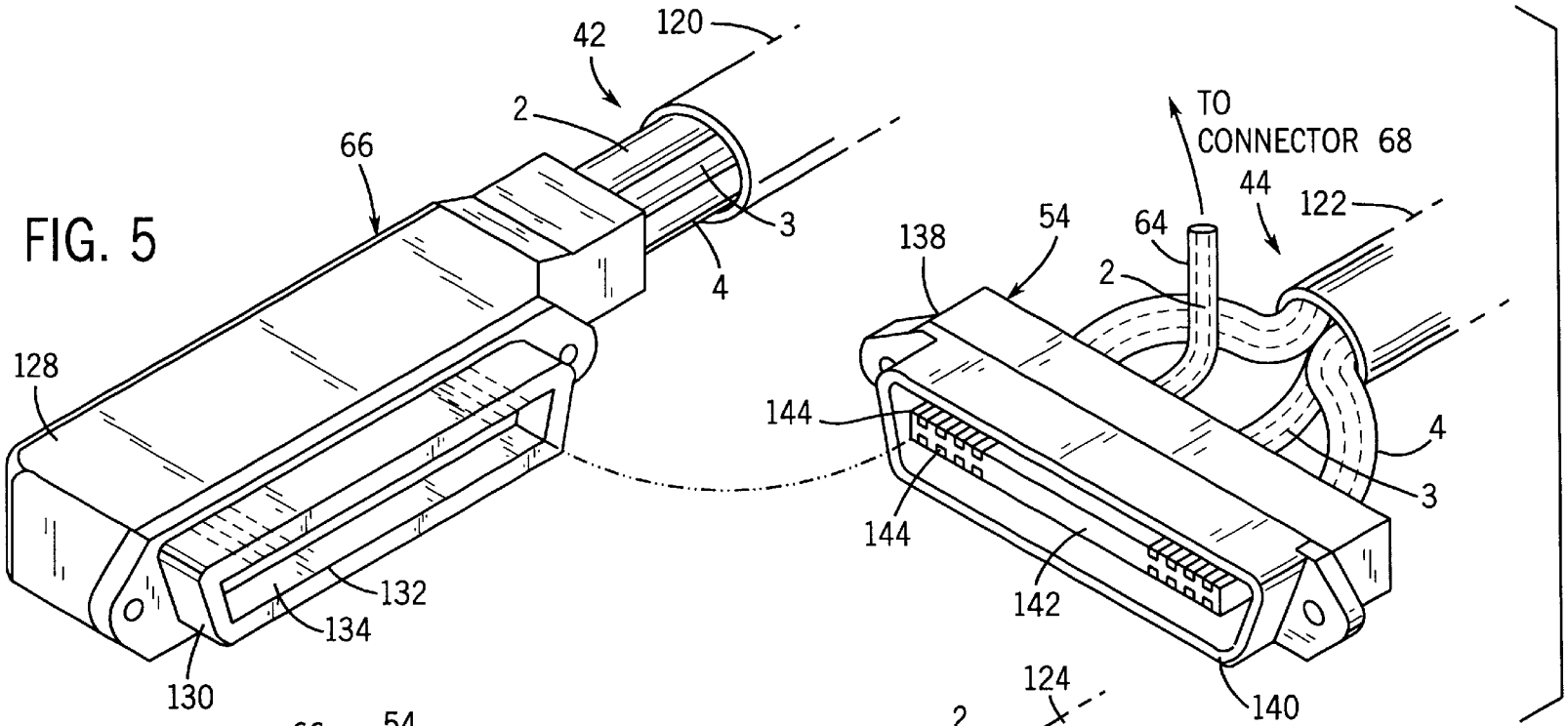
FIG. 5 is a perspective view illustrating an exemplary cable assembly having a first connector and a second exemplary cable assembly having a second connector, each cable assembly including the plurality of cable segments.
Figure 6:
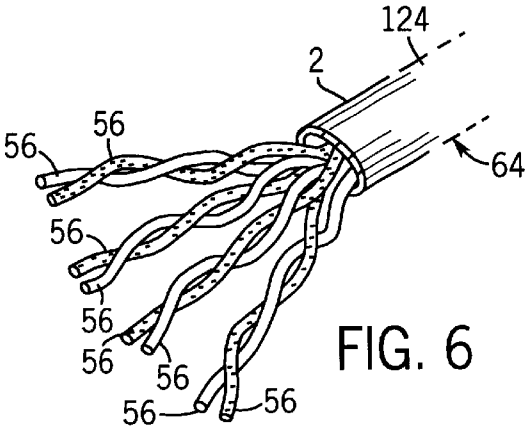
FIG. 6 is a perspective view of a cable segment of the second cable assembly with portions removed for purposes of illustration.
Figure 7:
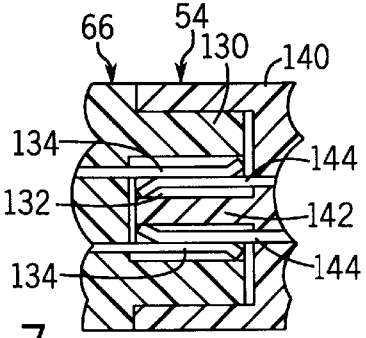
FIG. 7 is a fragmentary sectional view of the first connector and the second connector interconnected.

FIGS. 5–7 illustrate one exemplary embodiment of cable assemblies 42 and 44. FIG. 5 illustrates cable assemblies 42 and 44 including connectors 66 and 54, respectively. Cable assembly 42 optionally includes an outer sheath 120 encasing wire subsets 2, 3 and 4. Similarly, cable segment 44 optionally includes sheath 122 enclosing wire subsets 1, 3 and 4. If present, sheaths 120 and 122 preferably comprise polymeric flame-retardant sheaths. In addition, sheaths 122 are preferably shielded to prevent induced voltage from causing noise interference with wire subsets 1, 2, 3 and 4. Sheaths 120 and 122 may alternatively comprise elastic wrap, heat shrink over molding or potting to prevent relative movement between wire subsets 1, 2, 3 and 4 and to enhance the reliability by reducing inadvertent disconnection of individual wires from the connectors. It should also be clear that cable assemblies 42 and 44 need have no sheaths whatsoever, i.e., wire subsets 1, 2 and 4 and wire subsets 1, 3 and 4 could comprise unbundled cables.

FIG. 6 illustrates wire subset 2 of extraction lead 64 of cable assembly 44 in greater detail. As shown by FIG. 6, wire subset 2 includes four pairs of insulated twisted wires 56 further enclosed within a sheath 124 to form a cable segment. As with sheaths 120 and 122, sheath 124 preferably is a polymeric flame-retardant sheath and is preferably shielded to prevent induced voltage. Wire subsets 1, 3 and 4 are substantially identical to wire subset 2.

As shown by FIG. 5, wire subsets 2, 3 and 4 of cable assembly 42 terminate at connector 66. Connector 66 includes a body 128 having a male gender type mating portion 130 having a slot 132, along the perimeter of which are a plurality of electrical contacts 134. A portion of electrical contacts 134 are electrically connected to the individual wires 56 of wire subsets 2, 3 and 4 as will be explained in detail below.

As further shown by FIG. 5, wire subsets 1, 2, 3 and 4 terminate at connector 54. Connector 54 includes a body 138 having a female mating portion 140 surrounding a bar 142 which supports a plurality of electrical contacts 144 on its opposite sides. A portion of electrical contacts 144 are electrically connected to the individual wires 56 of each of wire subsets 1, 2, 3 and 4 as will be explained below. Wire subsets 2, 3 and 4 of cable assembly 42 terminate at specific electrical contacts 134 opposite to those electrical contacts 144 at which wire subsets 2, 3 and 4 of cable assembly 44 terminate, respectively.

FIG. 7 is a sectional view of connectors 54 and 66 interconnected. As shown by FIG. 7, when connectors 54 and 66 are interconnected, male mounting portion 130 of connector 66 projects into female mounting portion 140 of connector 54. At the same time, bar 142 of connector 54 projects into slot 132 thereby positioning electrical contacts 144 in electrical contact with electrical contacts 134.

Figure 8:
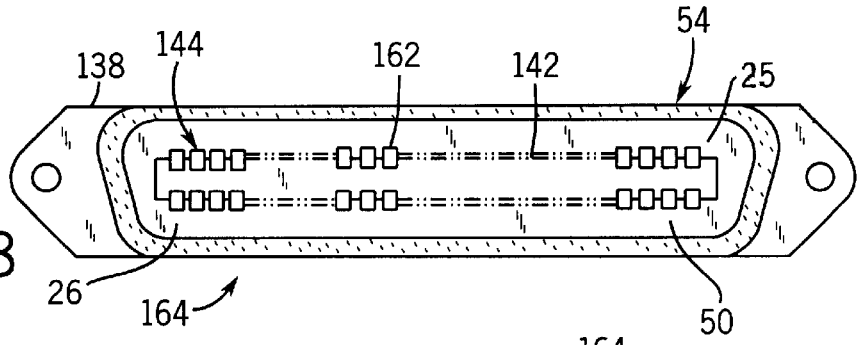
FIG. 8 is a front elevational view of the second cable assembly of FIG. 5.
Figure 9:
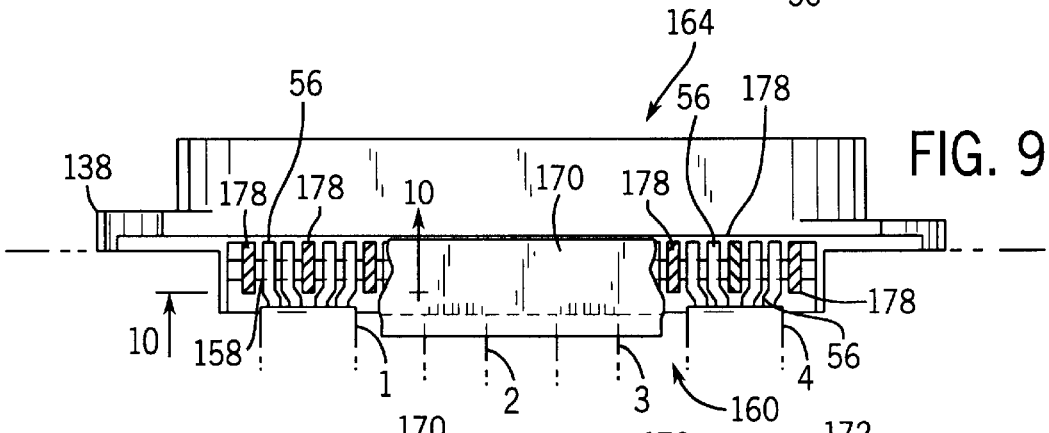
FIG. 9 is a top elevational view of the cable assembly of FIG. 8 with portions removed for purposes of illustration.
Figure 10:
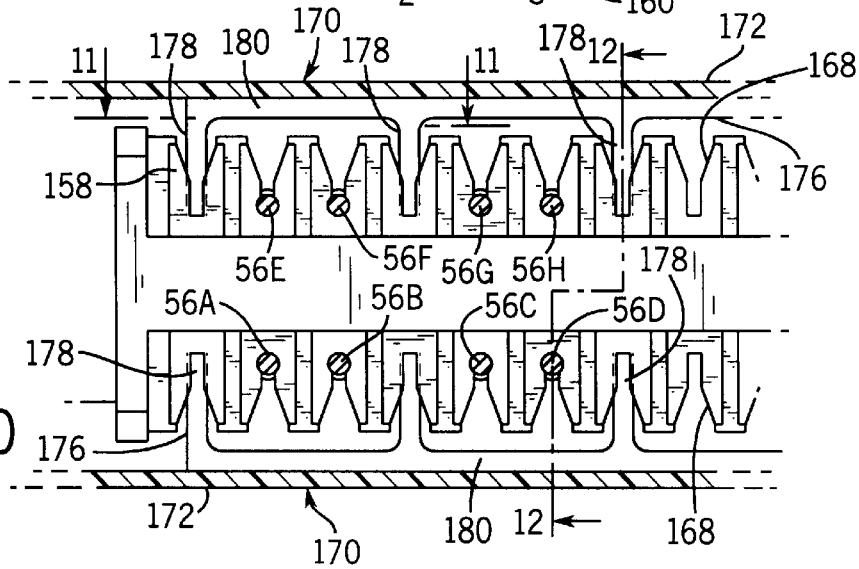
FIG. 10 is a sectional view of the second cable assembly of FIG. 9 taken along lines 10—10.

FIGS. 8–11 illustrate electrical contacts 144 of connector 54 in greater detail. As shown by FIGS. 8 and 10, each electrical contact 144 includes an insulation displacement portion 158 on first side 160 of connector 54 and a contact portion 162 on a second opposite side 164 of connector 54. As illustrated, connector 54 is a standard AMP 50 pin connector having contact portions 162 arranged in two parallel rows and conventionally numbered 1–25 along one row and 26–50 along the other row, with position 1 adjacent position 26 at one end and position 25 adjacent position 50 at the other end. Contact portions 162 are configured for electrically engaging and contacting the oppositely extending surfaces of corresponding electrical contacts of connector 66 as shown in FIG. 7.

Figure 11:
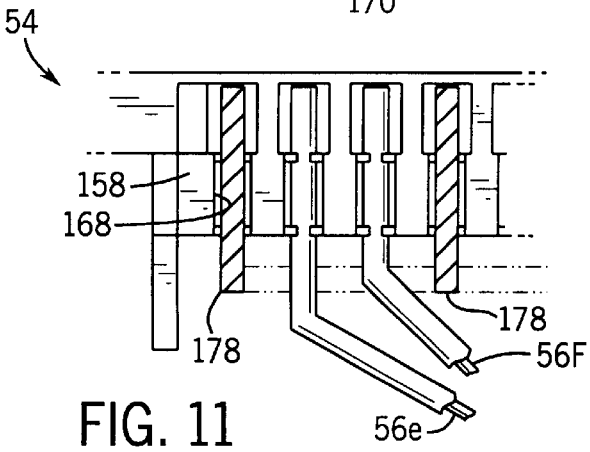
FIG. 11 is a sectional view of the second cable assembly of FIG. 10 taken along lines 11—11.

Insulation displacement portions 158 extend from contact portions 162 along side 160 of connector 54 and define a plurality of corresponding sockets 168 arranged in two parallel rows so as to receive wires 56. As best seen in FIG. 11, wires 56 are inserted into sockets 168 of insulation displacement portions 158 which cut through insulation about wires 56 to electrically contact wires 56.

As shown by FIGS. 9–11, wires 56 of subsets 1, 2, 3 and 4 are positioned within sockets 168 of electrical contacts 144 in a pattern designed to reduce cross-talk in the connector. More specifically, wires 56 of each twisted pair are inserted into adjacent sockets 168 of connector 54, but at least one socket 168 is skipped (i.e., no wire 56 is inserted therein) to provide an extra spacing between each two adjacent twisted wire pairs and also in the endmost positions of each row. Reference to the pattern for terminating wires 56 of subset 1 in connector 54 will suffice to make this more clear. As illustrated, subset 1 includes eight wires 56A–56H arranged as four twisted pairs. Wires 56A, 56B of one twisted pair are inserted in sockets 168 corresponding to respectively numbered positions 2 and 3 (i.e., the lower row in FIG. 10). Wires 56C, 56D of a second twisted pair are inserted in sockets 168 corresponding to respectively numbered positions 5 and 6 (lower row). Wires 56E, 56F of a third twisted pair are inserted in sockets 168 corresponding to respectively numbered positions 27 and 28 (upper row). Wires 56G, 56H of a fourth pair are inserted in sockets 168 corresponding to respectively numbered positions 30 and 31 (upper row). Thus, wires 56 of subset 1 are inserted into sockets 168 corresponding to numbered positions 2, 3, 5, 6, 27, 28, 30 and 31, while no wires 56 are inserted into sockets 168 corresponding to numbered positions 1, 4, 7, 26, 29 and 32 (i.e., those sockets are left empty). Wires 56 of subsets 2, 3 and 4 are terminated in connector 54 in similar patterns. Similarly, wires 56 of subsets 1, 2, 3 and 4 also terminate in connectors 52, 66 and 68 with this same pattern whenever those subsets are present.

Figure 12:
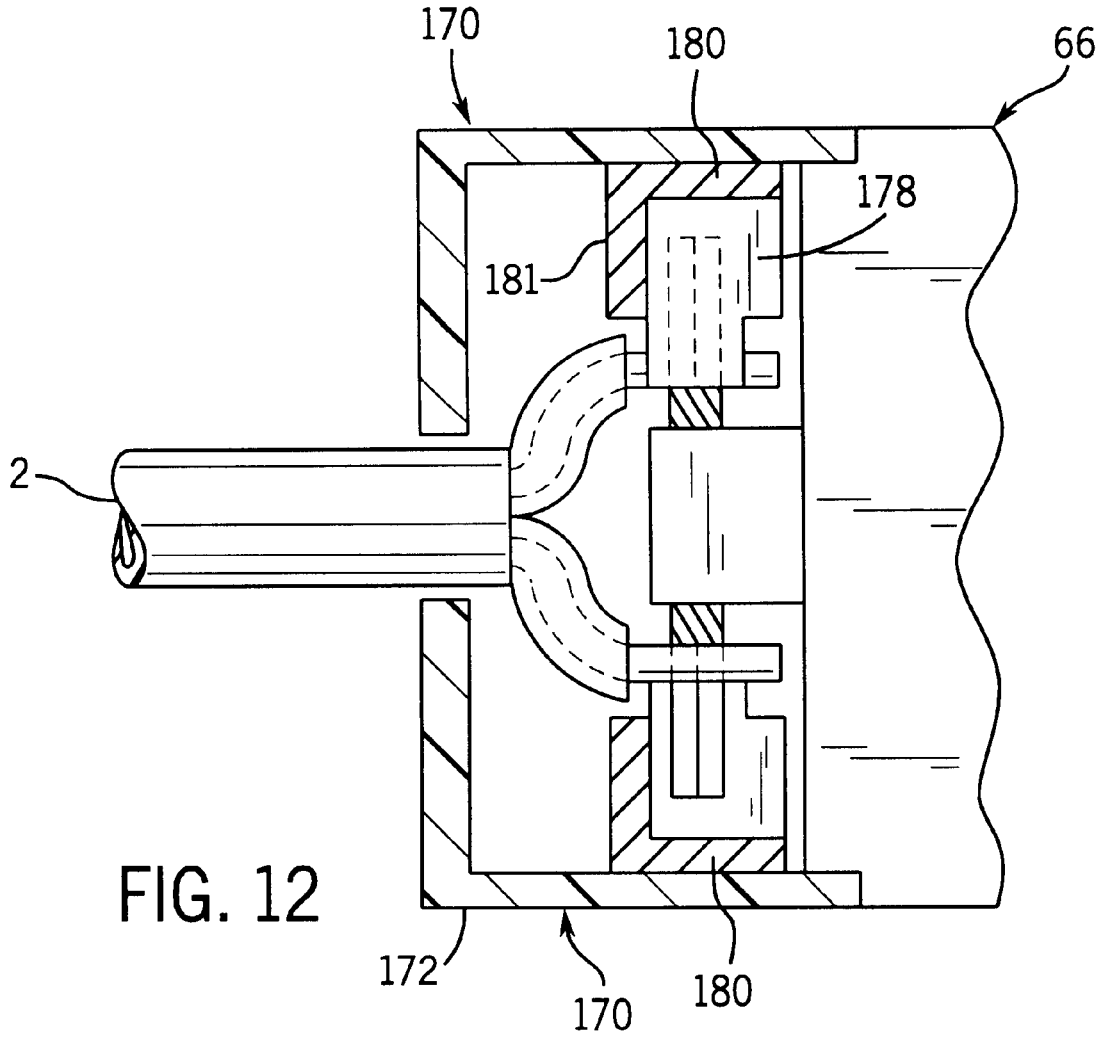
FIG. 12 is a sectional view of the second cable assembly of FIG. 10 taken along lines 12 - 12.

As further shown by FIGS. 9, 10 and 12, connector 54 includes devices 170 for even further reducing cross-talk. Cross-talk reduction devices 170 each include a body 172 and an electrically conducting member 176. Body 172 is configured for being releasably attached to body 138 of connector 54. Although body 172 is illustrated as being made of a plastic nonconductive material, body 172 may alternatively be formed from a variety of other materials including both conductive and nonconductive materials. Body 172 supports electrically conductive member 176.

Electrically conductive member 176 is configured to extend from a first electrical contact to at least one non-adjacent electrical contact of electrical contacts 144. In the exemplary embodiment illustrated, electrically conductive member 176 is configured to electrically interconnect the empty sockets 168 (i.e., the sockets which did not receive wires 56) of approximately every third electrical contact 144 along one row or both rows of connector 54. More particularly, electrically conductive member 176 is illustrated as including a plurality of spaced pins or projections 178 which are electrically connected to one another by a conductive housing 180 having a back shield and secured to body 172. Projections 178 and conductive housing 180 are made from an electrically conductive material such as copper. Projections 178 preferably comprise pins configured to extend from housing 180 and to project into and electrically engage the empty sockets 168 of insulation displacement portions 158 of selected electrical contacts 144.

As best shown by FIG. 11, each projection 178 preferably has a width approximately equal to or slightly greater than the diameter of one insulated wire 56. As a result, projections 178 are easily inserted into conventionally sized and configured empty sockets 168 of insulation displacement portions 158, and thereby reliably contact and electrically interconnect selected empty electrical contacts 144. In this manner, cross-talk reduction device 170 may be added onto and used with pre-existing and pre-manufactured connectors having standard electrical contacts 144 with sockets 168. Alternatively, in lieu of being releasably mountable to body 138, cross-talk reduction device 170 may be permanently manufactured as part of connector 54, or soldered directly to selected electrical contacts 144 after initial manufacture of connector 54. Moreover, cross-talk reduction device 170 may omit body 172 and may simply include projections 178 and conductive housing 180. In addition, projections 178 and conductive housing 180 may be omitted and replaced by multiple bar segments or housing segments carrying projections, by electrical wiring soldered or otherwise electrically connected to selected non-adjacent electrical contacts 144. Cross-talk reduction device 170 is preferably non-grounded. As will be appreciated, cross-talk reduction devices 170 may have numerous configurations and forms so long as selected non-adjacent empty electrical contacts 144 are electrically interconnected to one another.

It has been found that projections 178 of cross-talk reduction device 170 absorb energy which would otherwise be transferred between adjacent wires 56 at connector 54 and spread the energy evenly across all wires 56 positioned amongst projections 178. As a result, devices 170 dissipate energy and reduce cross-talk in each cable segment (known as local cross-talk). Reduction devices also reduce cross-talk by preventing signals in one cable segment from being induced in another cable segment within the cable assembly (also known as alien cross-talk).

The following table illustrates comparative test results of those connectors including cross-talk reduction device 170 with those connectors relying solely on empty sockets between adjacent wire pairs for cross-talk reduction. The comparative test results depicted below involved the use of a 154 foot length of BELDEN DATA TWIST 350 cable provided with AMP 50 pin connectors on both ends.

| | TEST 1 (WITHOUT CROSS-TALK REDUCTION DEVICE 170) | TEST 2 (WITH CROSS-TALK REDUCTION DEVICE 170) | |
|---|---|---|---|
| Attenuation | <24.0 db limit | <24.0 db limit | |
| Pairs 3, 6 | 8.6 db | 8.2 db | +.4 db |
| Pairs 1, 2 | 8.6 db | 8.3 db | +.3 db |
| Pairs 4, 5 | 8.4 db | 8.4 db | +.0 db |
| Pairs 7, 8 | 8.3 db | 8.3 db | +.0 db |
| Crosstalk | Limit > 28.3 db at 86.9 Mhz | Limit > 28.3 db at 86.9 Mhz | |
| Pairs 3, 6-1, 2 | 48.0 db | 50.0 db | +2.0 db |
| | 44.0 db | 45.8 db | +1.8 db |
| Pairs 3, 6-4, 5 | 46.2 db | 48.9 db | +2.7 db |
| | 49.7 db | 53.2 db | +3.5 db |
| Pairs 3, 6-7, 8 | 56.7 db | 56.1 db | −0.6 db |
| | 57.0 db | 48.1 db | −8.9 db* |
| Pairs 1, 2-4, 5 | 47.5 db | 54.1 db | +6.7 db |
| | 43.8 db | >60 db | +16.2 db |
| Pairs 1, 2-7, 8 | 50.9 db | 58.3 db | +7.4 db |
| | 51.0 db | 53.6 db | +2.6 db |
| Pairs 4, 5-7, 8 | 46.9 db | 50.0 db | +3.1 db |
| | 48.1 db | 50.0 db | +1.9 db |

*This particular pair was the only test that showed a negative improvement when a reduction device 170 was used. This indicates a faulty crimp or connection in the assembly process. Overall a considerable improvement is shown when using reduction device 170. This improvement is magnified when multiple cable assemblies are connected.

Thus, cross-talk reduction devices 170 substantially reduce near end cross-talk in cable assemblies 42, 44, 46 and 48. As a result, cable assemblies 42, 44, 46 and 48 are capable of transmitting electronic signals or data at faster transmission rates. In fact, it is believed that the addition of cross-talk reduction device 170, in the form illustrated or in the alternative forms as described above, will sufficiently reduce cross-talk such that the performance of Cat 5 (100 Mbps) connectors may be improved to Cat 6 or even Cat 7 to thereby enable cable assemblies 42, 44, 46 and 48 to be used to transmit data at higher rates.

Although cross-talk reduction devices 170 have been illustrated for use with connector 54 in cable assemblies 42, 44, 46 and 48, cross-talk reduction device 170 may alternatively be utilized in connectors 52, 66 and 68 or other connectors used in other cable assemblies or cable subsystems. As will further be appreciated, cross-talk reduction device 170 may be used in any conventional connector including a plurality of electrical contacts arranged in at least one row, regardless of the gender or type of connector or whether the cable assembly includes a diversion lead. Thus, cross-talk reduction device 170 may be used with each and every connector of a Y-cable assembly, an X-cable assembly, a horizontal distribution (HDC) cable assembly and various other cable assembly configurations.

Although the present invention has been described with reference to preferred embodiments, workers skilled in the art will recognize that changes may be made in form and detail without departing from the spirit and scope of the invention. For example, the cable assemblies could be configured with extraction leads which divert more than two wire subsets from the main lead, e.g., the main lead could have two wire subsets and the extraction lead two wire subsets. These and other modifications are considered to form part of the invention, which is limited only by the scope of the claims.

What is claimed is:

1. A communications cabling system comprising:

a set of unique cable assemblies configured to be serially connected to one another, each cable assembly in the set having a different internal structure and external color indicia from all the other cable assemblies to provide each cable assembly with a different function and appearance from all the other cable assemblies, each cable assembly including, a plurality of wires having first and second ends;

a first connector having a first plurality of electrical contacts electrically connected to each of the plurality of wires at the first end;

a second connector having a second plurality of electrical contacts electrically connected to a first unique subset of the plurality of wires at the second end;

a third connector having a third plurality of electrical contacts electrically coupled to a second unique subset of the plurality of wires at the second end; and a unique color indicia corresponding to and associated with each unique cable assembly, whereby the color indicia visually indicates at least one of the first and second unique subsets of wires terminating in the second and third connectors, respectively.

2. The cabling system of claim 1 wherein the cable assemblies are configured to be connected together in a serial chain in any order.

3. The cabling system of claim 1 wherein the cable assemblies are configured to be connected together in a serial chain so long as no two cable assemblies in the chain share the same color indicia.

4. The cabling system of claim 1 wherein at least some of the plurality of wires are contained within at least one cable segment.

5. The cabling system of claim 4 including:

a plurality of cable segments; and a sheath encasing the plurality of cable segments.

6. The cabling system of claim 1 wherein the plurality of wires is arranged in twisted pairs.

7. The cabling system of claim 1 wherein the first connector is of a first gender type and wherein the second and third connectors are of a second gender type.

8. The cabling system of claim 1 wherein the first connector of each of the cable assemblies has a first common color indicia.

9. The cabling system of claim 8 wherein the second connector of each of the cable assemblies has a second common color indicia.

10. The cabling system of claim 9 wherein the third connector of each of the cable assemblies has the unique color indicia.

11. The cabling system of claim 1 wherein the third connector has the unique color indicia.

12. The cabling system of claim 1 wherein the cabling system is configured for being installed adjacent a first side of a structure having a port communicating with a second side of the structure, wherein at least one of the first, second and third connectors is configured for being supported proximate the port and wherein said at least one of the first, second and third connectors includes a portion visually accessible from the second side of the structure, the portion including the unique color indicia.

13. The cabling system of claim 12 wherein the portion projects through the port.

14. The cabling system of claim 13 wherein the portion projects beyond the structure on the second side.

15. The portion of claim 12 wherein the structure includes a surface extending about the portion at the second side, and wherein the portion includes a face extending substantially parallel to the surface, the face including the unique color indicia.

16. The cabling system of claim 12, wherein the unique color indicia is co-molded as part of the portion.

17. A communications cabling system adapted for being installed adjacent a first side of a structure having a port communicating with a second side of the structure, the cabling system comprising:

a set of unique cable assemblies, each cable assembly in the set having a different internal structure and external indicia from all the other cable assemblies to provide each cable assembly with a different function and appearance from all the other cable assemblies, each cable assembly including, a plurality of wires having first and second ends;

a first connector having a first plurality of electrical contacts electrically connected to each of the plurality of wires at the first end;

a second connector having a second plurality of electrical contacts electrically connected to a first unique subset of the plurality of wires at the second end;

a third connector having a third plurality of electrical contacts electrically connected to a second unique subset of the plurality of wires at the second ends wherein at least one of the first, second and third connectors is configured for being supported proximate the port and wherein said at least one of the first, second and third connectors includes a portion accessible from the second side, the portion having a unique indicia corresponding to and associated with each unique cable assembly, whereby the unique indicia indicates at least one of the first and second unique subsets of wires terminating in the second and third connectors, respectively.

18. The cabling system of claim 17 wherein the portion is visually accessible from the second side.

19. The cabling system of claim 17 wherein the portion projects through the port.

20. The cabling system of claim 19 wherein the portion projects beyond the structure on the second side.

21. The cabling system of claim 17 wherein the structure includes a surface about the port at the second side, and wherein the portion includes a face extending substantially parallel to the surface, the face including the unique indicia.

22. The cabling system of claim 17 wherein the unique indicia comprises a unique color indicia.

23. The cabling system of claim 22 wherein the portion is co-molded with a material having the unique color indicia.

* * * * *